US008602905B2

(12) United States Patent
Steury et al.

(10) Patent No.: US 8,602,905 B2
(45) Date of Patent: Dec. 10, 2013

(54) PLAYGROUND ELEMENT AND METHOD OF MOUNTING THE SAME

(75) Inventors: J. Stephen Steury, Rogersville, MO (US); Tracy Archer, Monett, MO (US)

(73) Assignee: Miracle Recreation Equipment Co., Monett, MO (US)

( * ) Notice: Subject to any disclaimer, the term of this patent is extended or adjusted under 35 U.S.C. 154(b) by 195 days.

(21) Appl. No.: 13/334,232

(22) Filed: Dec. 22, 2011

(65) Prior Publication Data

US 2012/0165108 A1 Jun. 28, 2012

Related U.S. Application Data

(60) Provisional application No. 61/426,824, filed on Dec. 23, 2010.

(51) Int. Cl.
*A63B 9/00* (2006.01)
*A63G 31/00* (2006.01)

(52) U.S. Cl.
USPC ..... 472/136; 472/116; 482/36

(58) Field of Classification Search
USPC ..... 472/116, 117, 136; 482/34, 35, 36, 37
See application file for complete search history.

(56) References Cited

U.S. PATENT DOCUMENTS 1,877,833 A 9/1932 Ferrell
3,851,601 A * 12/1974 Davis ..... 108/158.11
3,853,074 A * 12/1974 Madey ..... 108/101
3,969,871 A 7/1976 Ewers
3,982,754 A 9/1976 de Moreau
7,594,874 B2 * 9/2009 Meissner ..... 482/36
8,028,555 B2 * 10/2011 Lurie ..... 70/371
8,469,405 B2 * 6/2013 Wheatley et al. ..... 285/314

FOREIGN PATENT DOCUMENTS

CN 201451026 5/2010

OTHER PUBLICATIONS

European Search Report from corresponding EP Application No. 11195563 dated Mar. 15, 2012.
European Search Report from corresponding European Application No. 11195563 mailed Mar. 30, 2012.

* cited by examiner

*Primary Examiner* — Kien Nguyen
(74) *Attorney, Agent, or Firm* — Polster Lieder Woodruff & Lucchesi, L.C.

(57) ABSTRACT

A playground system includes a support post secured to a foundation, a play unit defining a passageway; and a cam assembly configured to secure the play unit to the support. The cam assembly includes a cam base sized and shaped for engagement with the play unit, and a cam. The cam assembly also includes a cam lock sized and shaped for engagement with the play unit within the passageway, and a slot sized and shaped for seating the cam. The slot defines a plurality of steps being sized and shaped to seat the cam to provide an adjustment range to accommodate for variances in sizes and tolerances of the play unit and support.

20 Claims, 7 Drawing Sheets

PLAYGROUND ELEMENT AND METHOD OF MOUNTING THE SAME

CROSS-REFERENCE TO RELATED APPLICATIONS

This Non-Provisional application claims priority to U.S. Provisional Application Ser. No. 61/426,824 filed Dec. 23, 2010, and which is incorporated herein by reference.

STATEMENT REGARDING FEDERALLY SPONSORED RESEARCH

Not Applicable.

BACKGROUND OF THE INVENTION

This invention relates generally to playground equipment, and in particular, to an apparatus and method for supporting a play unit on a support post.

Mounting a rotational molded play unit in a playground system can be challenging. For example, drilling a rotational molded play unit is not desirable because it can fill with water which can freeze during cold weather and damage the plastic part. In addition, tolerances due to part variance and expansion and contraction due to temperature changes also make mounting difficult. Variation in molding tolerances and differences in plastic shrink can occur with different colors of plastic.

Therefore, what is needed is an apparatus and method of mounting a plastic part that accommodates for variances and changes in tolerances.

SUMMARY

Briefly stated, a playground system comprises one or more play units supported on one or more support posts which are secured to a foundation. The play unit defines a passage way, and a cam assembly is provided to secure the play unit to the post. The cam assembly comprises a cam base plate and a cam lock. The cam base plate defines an opening sized and shaped to receive the support post, and includes at least one upright extending upwardly from the base plate, with a cam extending inwardly from the upright toward the support post. The cam base plate can define a ring, or can be shaped to correspond generally to the shape of decking defined by the play unit. The cam lock comprising a cover plate with a circular cam wall extending from the cover plate. The cam lock cover plate can define a ring, or can be solid. The cam wall is sized and shaped receive the support post. An opening in the cam wall is sized and shaped to receive the cam. Further, the cam wall includes an upwardly sloping slot extending from the cam wall opening. The slot is sized to receive said cam. The play unit is sandwiched by the cam base plate and the cam lock cover plate. As the cam lock is rotated relative to the cam base, the cam lock is tightened down on the play unit to secure the play unit in place on the support post.

According to one aspect, the slot defines a plurality of steps which are sized and shaped to seat the cam to provide an adjustment range to accommodate for variances in sizes and tolerances of the play unit and support.

In accordance with another aspect, the cam assembly comprises a securement member which extends through the upright of the cam base to engage the support post.

In accordance with another aspect, the play unit can be polygonal and include an end structure at each apex or corner of the play unit. In this play unit, each end structure includes a passage way, and the play unit is supported by a plurality of posts. In a variation, the passage way is in the center of the play unit, and the play unit is supported (or supportable) by a single support post.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
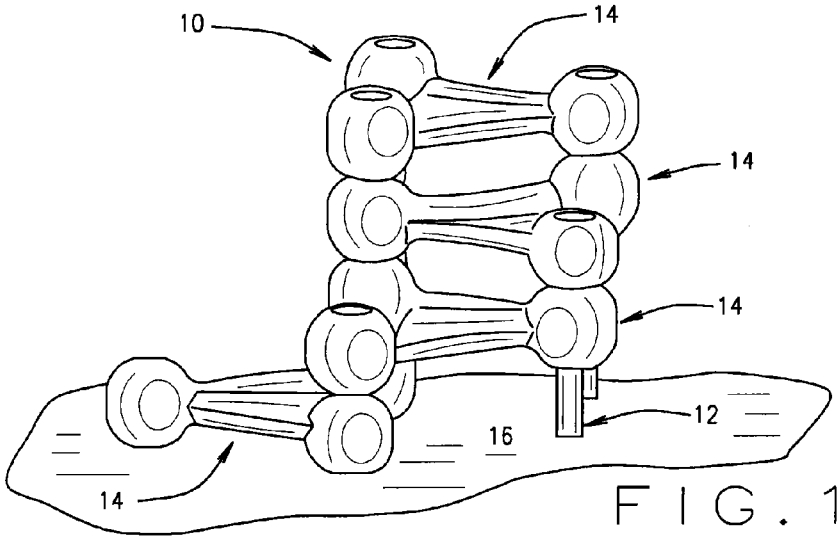
FIG. 1 is a perspective view of an embodiment of a playground system.
Figure 2A:
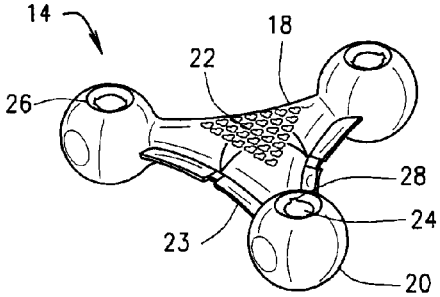
FIG. 2A is a perspective view of an embodiment of a play unit.
Figure 2B:
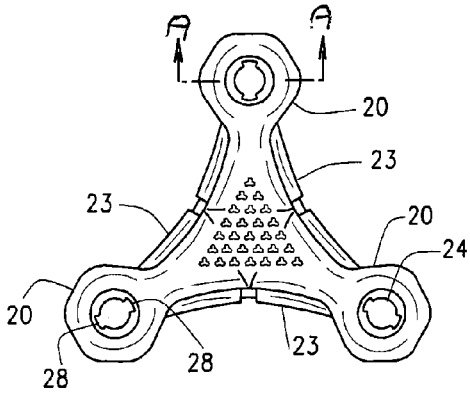
FIG. 2B is a top view of an embodiment of the play unit.
Figure 2C:
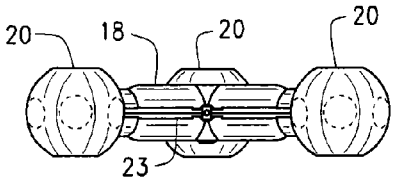
FIG. 2C is a side view of an embodiment of the play unit.
Figure 2D:
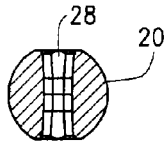
FIG. 2D is a section view of a an end structure along Section A-A of FIG. 2B.
Figure 3A:
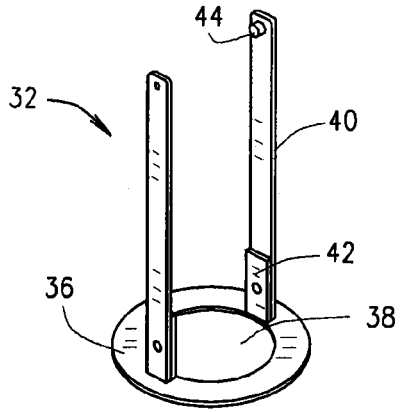
FIG. 3A is a perspective view of an embodiment of a cam base of a cam assembly.
Figure 3B:
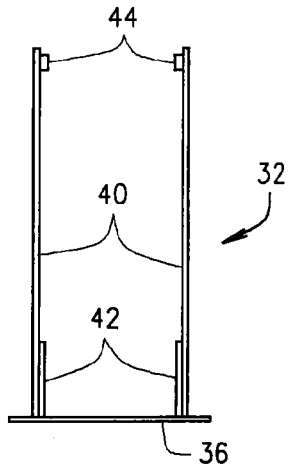
FIG. 3B is a side elevational view of the cam base.

The following detailed description illustrates the claimed invention by way of example and not by way of limitation. The description clearly enables one skilled in the art to make and use the claimed invention, describes several embodiments, adaptations, variations, alternatives, and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

As shown in FIGS. 1-6, a playground system 10 includes support posts 12 for supporting and positioning a plurality of play units 14 in a predetermined pattern.

Each support post 12 is preferably a cylindrical post with a lower end secured to a foundation 16 or mounted in the ground. For example, a hole can be dug in the foundation or ground 16 for receipt of the lower end of the support post 12 and filled with concrete to secure and stabilize the post in a generally vertical position. Alternatively, the support posts 12 can be attached to the foundation with fasteners. The support posts 12 can be made from any suitable material, including, but not limited to, metal, plastic, and wood.

Figure 5A:
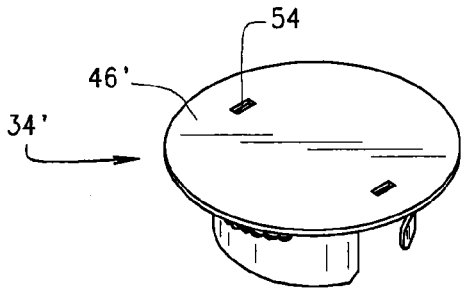
FIG. 5A is a perspective view of an alternate embodiment of the cam lock.
Figure 5B:
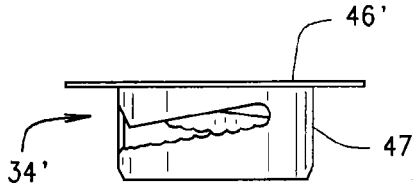
FIG. 5B is a side view of the cam lock of FIG. 5A.
Figure 5C:
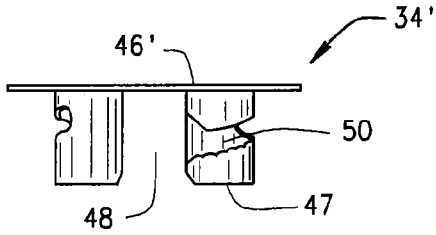
FIG. 5C is a front view of the cam lock of FIG. 5A.
Figure 6:
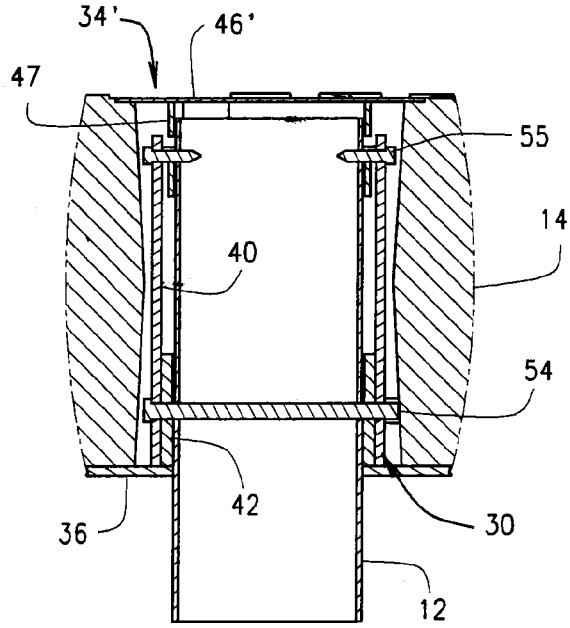
FIG. 6 is a cross-sectional view of the play unit mounted on a support post using the cam assembly.

In FIGS. 1-6, each play unit 14 has a generally triangular decking area 18 with a generally spherical end structure 20 defined at about each vertex of the decking area 18. Although shown as being generally triangular, the decking area (and hence the overall shape of the play unit) can be any other desired geometric shape. The end structures 20 are preferably spaced at equidistant angles relative to each other, such as about 120°. However, any suitable angle can be used. As can be appreciated, the spacing of the end structures 20 relative to each other will depend on the shape of the decking 20. The upper and lower surfaces of the decking area 18 define a texture 22 for improvement of traction. Ribs 23 defined along edge portions of the decking area 18 are shaped and sized to strengthen the play unit 14 and to provide an edge for gripping or grasping by those playing on the play unit. The play unit 14, each end structure defines passages 24 which extend through the each of the end structures to open at the top and bottom of each end structure. As seen, the passages 24 are generally perpendicular to the decking area 18. A recessed area 26 surrounds the opening of the passages 24 at the top and bottom of the end structures, and a pair of opposed notches or channels 28 extend the length of the passage 24 along the inner surface of the channels 28. The passages 24 sized and shaped for engagement with a corresponding support post 12, and are mounted on the support post 12 by means of a cam assembly 30, as shown in FIG. 6, and as will be described below.

The overall size and shape of the play unit 14 should be self-supporting and capable of supporting the weight of persons and other typical forces encountered during use of playground equipment. Each play unit 14 can be manufactured using any suitable method, including, but not limited to rotational molding, injection molding, blow molding, thermoforming, or other processes. As can be apparent, if the play unit 14 is formed in any of these just noted ways, it is made from a plastic. However, the play unit could be formed from other materials as well.

Figure 4A:
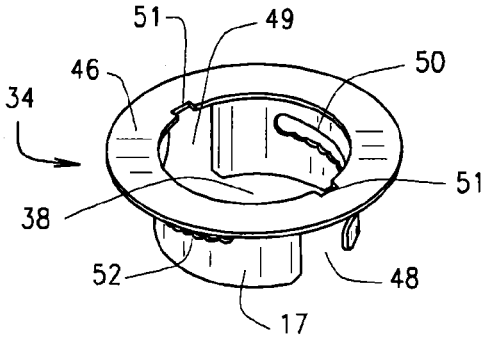
FIG. 4A is a perspective view of an embodiment of a cam lock of the cam assembly.
Figure 4B:
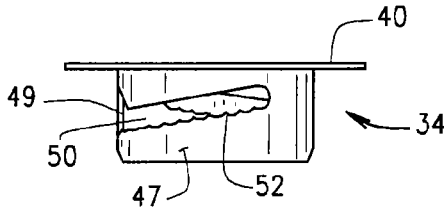
FIG. 4B is a side view of the cam lock.
Figure 4C:
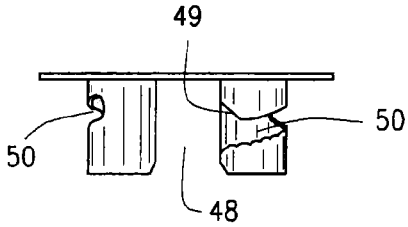
FIG. 4C is a front view of the cam lock.

The cam assembly 30 includes a cam base 32 (FIGS. 3A-B) and a cam lock 34 (FIGS. 4A-C). The cam base 32 includes a generally circular base plate 36 sized and shaped to seat within the recessed areas 26 about the passage 24 of the play unit 14. The circular base plate 36 defines a generally circular opening 38 sized to receive the support post 12. The base plate thus defines a ring. Two generally parallel uprights 40 extend generally perpendicularly from the base plate 36. The uprights 40 are positioned on the base plate 36 at the inner surface of the ring defined by the base plate. The uprights 40 can be fixed to the base plate 36 by means of arms 42, such as by welding or fasteners. The arms 42 can be integral with the base plate 36 and can serve to reinforce the attachment between the uprights 40 and the base plate 36. Alternatively, the uprights 40 can be integral with the base plate 36, thus avoiding the need for the arms 42. A generally cylindrical cam 44 extends inwardly from each inner face of the uprights 40 at the upper end of the uprights. The cam 44 can be fixed to the upright by welding, for example. The cams 44 thus face each other. The cam 44 is shaped and sized for engagement with the cam lock 34. As seen in FIG. 6, the base plate 36 is sized to be received over the support post 12 with the uprights being spaced slightly from the support post 12 by the arms 42. The uprights 40, in turn, are sized to be received in the channels 28 of the passages 24 of the end structures 20. The cams 44 extend toward the support post 12, and can be sized to engage.

The cam lock 34 includes a generally circular cam cover plate 46 and a generally cylindrical wall 47 which extends generally perpendicularly to the cover plate 46 (FIGS. 4A-4C). The cam cover plate 46 is shaped and sized to seat within the recessed areas 26 about the passage 24 of the play unit 14. The cover plate 46 defines an opening 49 sized to receive the support post 12. The cover plate thus is annular or ring-shaped. The pair of opposed notches 51 extend outwardly from the inner edge of the annular edge of the cover plate. The cam lock wall 47 defines a pair of opposed generally vertical openings 48. An inclined slot 50 extends from the edge of each opening 48. The opening to the slot 50 is beveled, as at 49. Each slot 50 defines a plurality of steps 52 that are sized and shaped to seat the cam 44. The steps 52 provide for an adjustment range to accommodate for variances in the sizes and tolerances of the play unit 14 and the support post 12. The steps 52 are preferably radiused.

FIG. 5A-5C depicts an alternate embodiment of the cam lock 34'. In this embodiment, the cam lock cover plate 46' does not have an opening 38, and hence does not have the notches 51. Rather, openings 54 are formed in the cover plate 46 which correspond to the notches 51 of the cam lock cover plate 46. The cam lock 34 is used in when the play unit 14 is secured to the support post along the length of the support post (i.e., the support post extends through the passage 24 of the play unit). The alternate cam lock 34', on the other hand, is to be used when the play unit is at the top of the support post 12. As can be appreciated, the cam lock 34' will close the top of the support post 12.

To assemble the playground system 10, the supports 12 are mounted to a foundation 16 or in the ground in a predetermined pattern. The cam base 32 is slid over one of the supports 12 so that the support 12 extends through the cam base opening 38 and the uprights 40 extend upwardly. The cam base 32 is secured to the support 12 using a lower fastener 54 (FIG. 6) which extends through the uprights 40, the arms 42 and the support post 12. Upper fasteners 55 extend through the uprights 40, the cams 44 and extend into the support post 12. One of the end structures 20 of the play unit 14 is then slid over the support 12 until the end structure 20 rests on the cam base 32 with the base plate 36 seated in the recessed area 26 of the end structure 20. As can be appreciated, the cam base 32 will support the weight of the play unit 14 and the vertical forces applied to the play unit 14 during use. The position of the uprights 40 correspond with the position of the channels 28 of the end structure passages 24, and the cams 44 on the uprights 40 face the support 12.

As a next step in the mounting of the play unit 14 on the support post 12, the cam lock 34 is slid over the support 12 until the cam lock wall 47 inserts into the passage 24 of the end structure 20 and the cover plate 46, 46' seats against the recessed area 26. As can be appreciated, the passage 24 of the end structure 20 has a diameter greater than the diameter of the support post 12, such that the cam lock wall 37 can be received in an annular space defined by the support post 12 and the passage 24. The slots 48 in the cam lock wall 47 enable the wall 47 to pass over the upper fasteners 55 and the cams 44. In this position, openings to the slots 50 in the cam lock wall 47 are generally aligned with the upper fasteners 55 and cams 44. The cam lock 34 is rotated to an engagement position where the upper cams 44 engage the steps 52 of the slots 50. To this end, the cams 44 preferably have a radius that corresponds to the radius of the steps 52. As noted above, the slots 50 are sloped upwardly. Thus, as the cam lock 34 is rotated relative to the post (and the cams), the cam lock 34 is tightened against the top surface of the end structure 20. The further the cam lock 34 is rotated, the tighter the engagement.

Figure 12A:
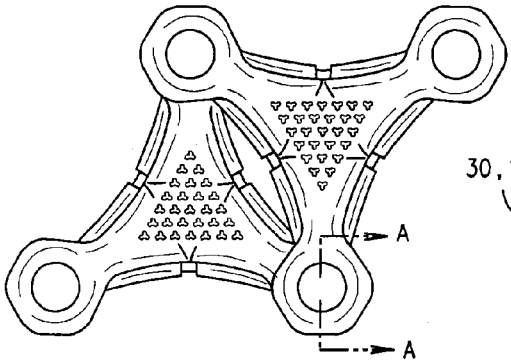
FIG. 12A is a top view of play system comprised of two play units of FIG. 2A mounted to support posts, there being a support post at each apex of the play units.
Figure 12B:
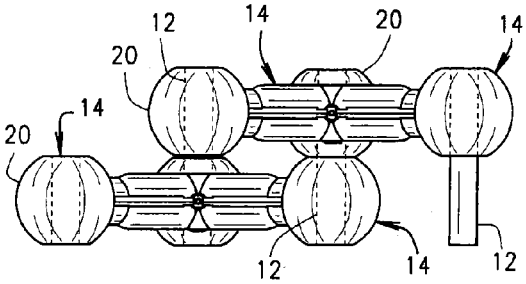
FIG. 12B is a side view of play system of FIG. 12A two play units mounted to a single support post.

Using this assembly method, additional play units 14 can attach to the supports 12 to form the playground system 10. Those skilled in the art will recognize that the supports 12 and play units 14 can be arranged in a multitude of patterns. As can be appreciated, the play units 14 are supported by multiple support posts 12, there being a support post 12 for each end structure 20, as seen in FIG. 12B.

Figure 10A:
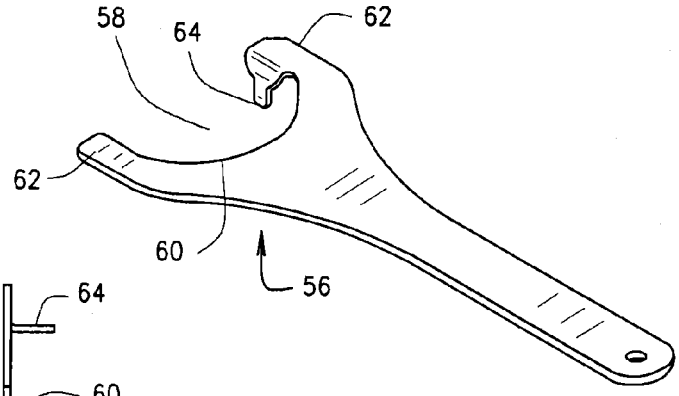
FIG. 10A is a perspective view of an embodiment of a tool used to secure the cam lock to the cam base.
Figure 10C:
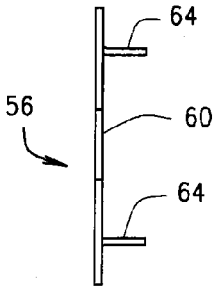
FIG. 10C is a front view of the tool.
Figure 10B:
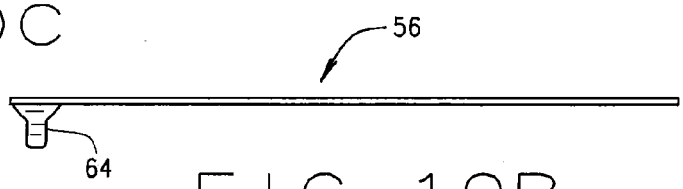
FIG. 10B is a side view of the tool.

The cam lock 34 can be rotated using the tool 56 shown in FIGS. 10A-C. As seen, the tool includes a mouth 58 having a radiused back edge 60. The sides of the mouth define arms 62 which have downwardly extending fingers 64. These fingers are sized to be received in the notches 51 of the open cam lock 34 and the openings 54 of the closed cam lock 34'. The tool 56 thus positively engages the cam lock 34, 34' to enable an assembly to rotate the cam lock within the passage 24 of the end structure 20.

Figure 7:
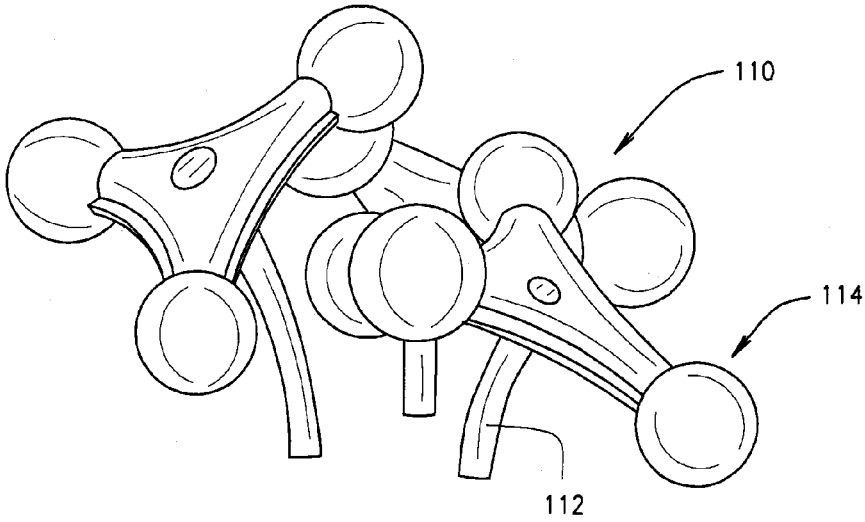
FIG. 7 is a perspective view an alternate embodiment of the playground system.

FIGS. 7-9 illustrate an alternate embodiment of the playground system 110, which includes support posts 112 for supporting and positioning a plurality of play units 114 in a predetermined pattern. In the play system 10, comprised of play units 14, the support posts extended through end structures 20 of the play units. In the play system 110, the support posts 112 extend through the center of the play units 114, and the play units 114 are supported by a single post, rather than multiple posts. As can be appreciated, engagement of the passage channels 128 with the uprights 140 of the cam base 132 (which is fixed to the support post 112) will help to rotationally fix the play unit 114 to the support post 112. If desired, a play system could be constructed using play units 14 and play units 114.

The support posts 112 are generally similar to the support posts 12. However, because a single support post 112 is used to support the play unit 114, the support post 112 can be an arced cylindrical post. A lower end of the support post 112 is secured to or mounted in a foundation 116 the ground. For example, a hole can be dug in the foundation for receipt of the lower end of the support and filled with concrete to secure and stabilize the post in a generally vertical position. Alternatively, the support posts 112 can be attached to the foundation with fasteners. The support posts 112 can be made from any suitable material, including, but not limited to, metal, plastic, and wood.

Figure 8A:
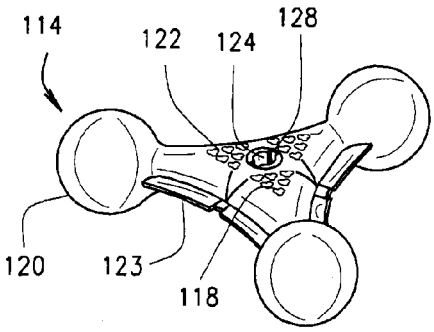
FIG. 8A is a perspective view of an alternate embodiment of the play unit used with the playground system of FIG. 7.
Figure 8B:
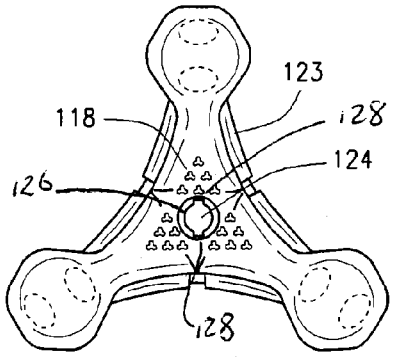
FIG. 8B is a top view of the play unit of FIG. 8A.

Each play unit 114 has a generally planar decking area 118 with defined end structures 120 positioned along the edge of the decking area 118. In FIGS. 8A-8B, each play unit 114 has a generally triangular decking area 118 with a generally spherical end structure 120 defined at about each vertex of the decking area 118. The structures are preferably spaced at equidistant angles relative to each other, such as about 120°. However, any suitable angle can be used. Although shown to be generally triangular, the play units 114 can have any desired geometric shape, or they can be circular. Further, they can be formed without the end structures 120, if desired. The upper and lower surfaces of the decking area 118 define a texture 122 for improvement of traction. Ribs 123 defined along edge portions of the decking area 118 are shaped and sized to strengthen the play unit 114 and to provide an edge for gripping or grasping by those playing on the play unit 114. The decking area 118 defines a passage 124 which extends through the decking area and which is opened at a top and bottom surfaces of the decking area. The passage 124 is generally centered relative to the decking area 118. Recessed areas 126 surround each opening of the passage 124 and are sized and shaped for engagement with a cam assembly 130 to mount the play unit 114 to a support post 112. Additionally, opposed notches 128 extend the length of the passage 124.

The overall size and shape of the play unit 114 should be self-supporting and capable of supporting the weight and other typical forces encountered during use of playground equipment. Each play unit 114 can be manufactured using any suitable method, including, but not limited to rotational molding, injection molding, blow molding, thermoforming, or other processes. As can be apparent, if the play unit 14 is formed in any of these just noted ways, it is made from a plastic. However, the play unit could be formed from other materials as well.

Figure 9A:
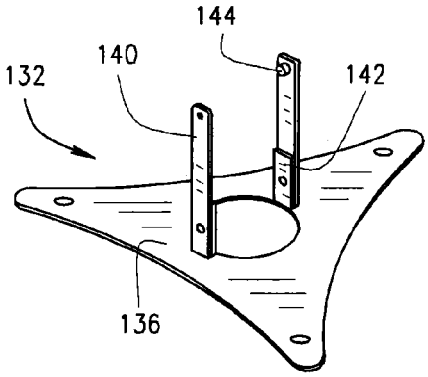
FIG. 9A is a perspective view of an alternate embodiment of a cam base.
Figure 9B:
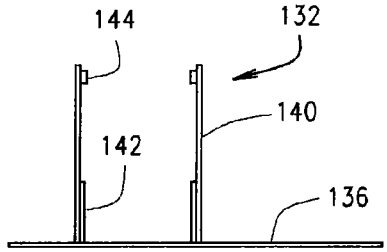
FIG. 9B is a side view of the base cam of FIG. 9A.

The cam assembly 130 includes a cam base 132 and the cam lock 34 or 34' (depending on where the play unit is positioned on the support post). The cam base 132 is substantially identical to the cam base 32. However, rather than have a ring shaped base plate, the cam base 132 includes a base plate 136 that is shown to be generally triangular (FIGS. 9A-9B). Hence, the cam base plate 136 corresponds to the general shape of the play unit decking 118. The playground system 110 is assembled in substantially the same way as set forth above in conjunction with the playground system 10.

Figure 13:
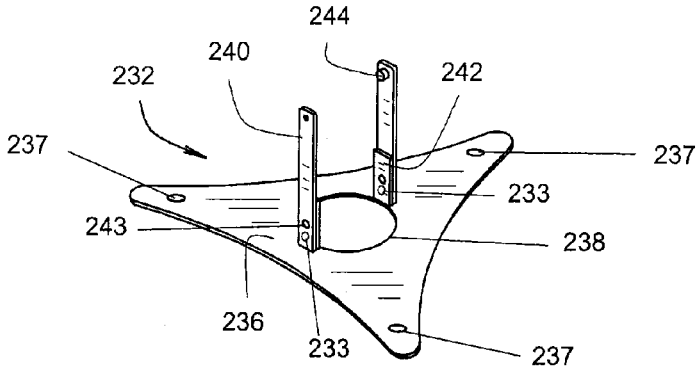
FIG. 13 is a perspective view of a second alternate embodiment of a cam base.
Figure 14A:
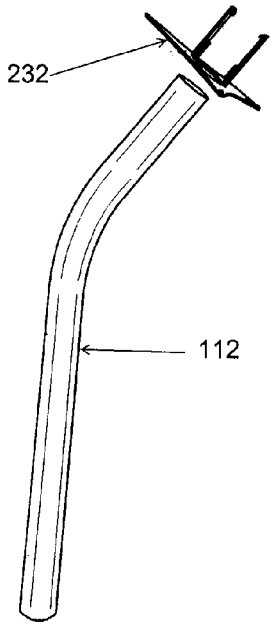
FIG. 14A is perspective view of the cam base of FIG. 13 being applied to a support post.
Figure 14B:
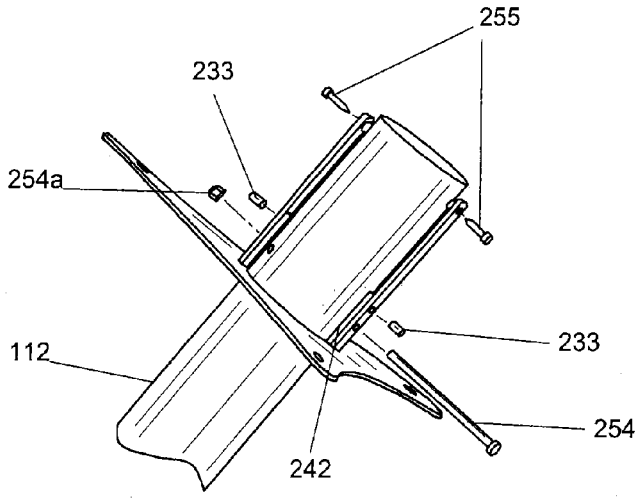
FIG. 14B is perspective view of the cam base of FIG. 13 engaged with a support post.

FIG. 13 illustrates another alternate embodiment of the cam base 232, which is substantially similar to the cam base 132. However, the cam base 232 includes securement members 233 that engage the support 112 to counter directional forces on the play unit 114 that can occur when children play on play systems comprised of play units 114.

The cam base 232 includes a generally triangular base plate 236 having an area somewhat smaller than the area of the bottom surface of the play unit 114. The triangular base plate 236 defines a generally circular opening 238 sized to receive the support 112. The base plate 236 includes holes 237 proximate its corners. Two generally parallel uprights 240 extend generally perpendicularly from the base plate 236. The uprights 240 are positioned on the base plate 236 at the inner surface of the ring. The uprights 240 can be fixed to the base plate 236 by means of arms 242, such as by welding or fasteners, which will actually space the uprights 240 slightly from the of the base plate opening 238. The arms 242 can be integral with the base plate 236 and can serve to reinforce the attachment between the uprights 240 and the base plate 236. Alternatively, the uprights 240 can, themselves, be integral with the base plate 236, thus eliminating the need for the arms 242. Each upright 240 and corresponding arm 242 defines a threaded hole 243 sized and shaped for receipt of the securement member 233, such as a set screw. A generally cylindrical cam 244 extends inwardly from the inner face of each of the uprights 240, near the top thereof. The cams 244 can be fixed to the uprights by welding, for example. If the uprights 240 are opposed to each other, the cams 244 face each other. The cams 244 are shaped and sized for engagement with the cam lock 34, 34' (as described above in conjunction with the cam assembly 30).

During assembly, the cam base 232 is slid over one of the supports 112 so that the support 112 extends through the cam base opening 238 and the uprights 240 extend upwardly. The cam base 232 is secured to the support 112 using a lower fastener 254 which extends through the uprights 240, the arms 242, the arms 244 and the support post 112. The fastener 254 can be a bolt which receives a nut 254*a*. Upper fasteners 255 extend through the cams 244 at the upper ends of the uprights 240 and into the support 112. The securement members 233 insert through the holes 243 until the securement members 233 engage the support post 112, to create a secure connection between the securement member 233 and the support post 112. The remaining assembly of the playground system 110 is substantially the same way as set forth above in conjunction with the playground system 10.

Figure 11:
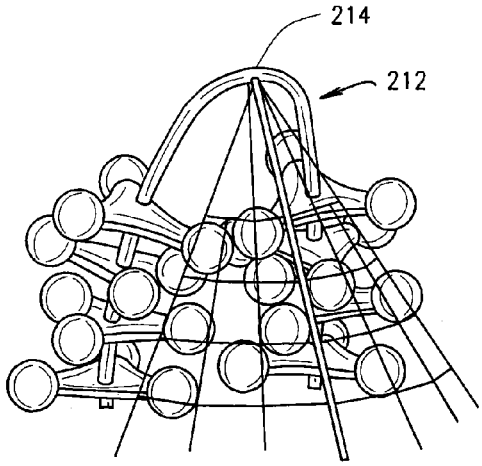
FIG. 11 is a perspective view of a play system comprised of the play units of FIG. 8A mounted to an arced support post.

FIG. 7 shows a play system comprised of play units 214 wherein the posts 112 are curved, or otherwise define an arc. In FIG. 11, a play system is comprised of play units 114, however, the support post supports 212 is an arcuate, or generally U-shaped, member 214. FIGS. 7 and 11 thus demonstrate the versatility of the system made from the play units and the types of support posts which can be used with the cam assembly 30.

Figure 12C:
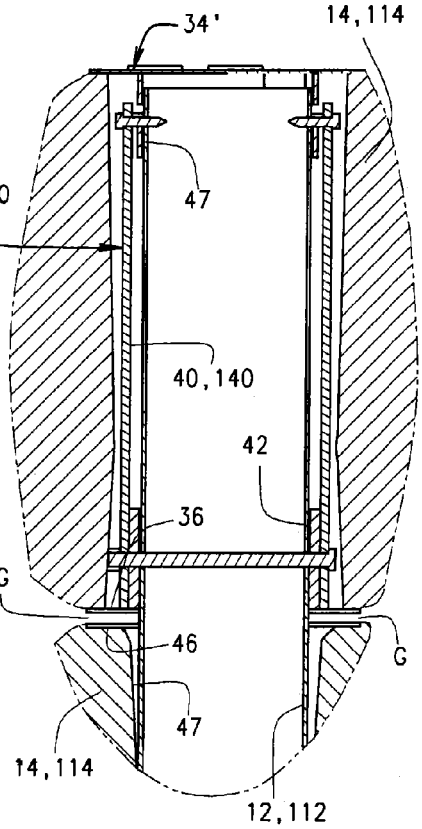
FIG. 12C is a cross-sectional view taken along line A-A of FIG. 12A showing the mounting of the two play units to a support post.

As can be appreciated from the above, the two play units 14, 114 can be mounted on straight or arced supports. Play systems can be comprised of only the play units 14, only the play units 114, or a combination of the two (FIGS. 12A-12C).

A support 12, 112 can have only a single play unit 14, 114 mounted thereto, or two or more play units 14, 114 can be mounted to a single support. When two or more play units 14, 114 are mounted to a single support, each play unit 14, 114 is supported by its respective cam assembly 30, 130. When two play units are mounted to the support, the lower play unit does not support the upper play unit. As noted, each play unit is supported on the support 12, 112 by its respective cam assembly 30, 130. Further, there is a least a small gap G between adjacent play units, as shown in FIG. 12C.

Changes can be made in the above constructions without departing from the scope of the invention, it is intended that all matter contained in the above description or shown in the accompanying drawings shall be interpreted as illustrative and not in a limiting sense. For example, although the end structure 20 is shown to be generally spherical, it can be formed in any desired shape.

What is claimed is:

1. A playground system, comprising:

a support post secured to a foundation;

a play unit defining a passageway; and a cam assembly configured to secure the play unit to the support post; the cam assembly comprising:

a cam base comprising a base plate defining an opening sized and shaped to receive the support post, at least one upright extending upwardly from the base plate, and a cam extending inwardly from the upright toward the support post; and a cam lock comprising a cover plate, a circular cam wall sized and shaped to receive the support post extending from the cover plate, an opening in the cam wall sized to receive the cam and an upwardly sloping slot extending from the cam wall opening which is sized to receive said cam; whereby, as said cam lock is rotated relative to said cam base, said cam lock is tightened down on said play unit.

2. The playground system of claim 1, wherein the slot defines a plurality of steps being sized and shaped to seat the cam to provide an adjustment range to accommodate for variances in sizes and tolerances of the play unit and support post.

3. The playground system of claim 1, wherein the cam assembly comprises: a securement member which extends through the upright of the cam base to engage the support post.

4. The playground system of claim 1, the play unit comprising a decking area; and a defined structure along an edge of the decking area.

5. The playground system of claim 4, wherein the defined structure is an end structure located at an apex of the play unit.

6. The playground system of claim 5, wherein the passage way is located in the end structure.

7. The playground system of claim 1 wherein the play unit comprises a decking area and the passage way extends through the decking area.

8. The playground system of claim 1 wherein the cover plate of said cam lock defines a ring.

9. The playground system of claim 1 wherein the cover plate of said cam lock is solid.

10. The playground system of claim 1 wherein play unit passage defines an elongate channel sized and shaped to receive the upright of the cam base.

11. A cam assembly for a play unit with a passageway, the cam assembly comprising:

a cam base comprising a base plate having an opening sized and shaped to receive a support post, an upright extending generally perpendicularly from the cam base, and a cam extending inwardly from the upright; and a cam lock having a cover plate, a wall extending from the top plate, an opening formed in the wall sized and shaped to receive the cam, and an upwardly sloping slot, the slot being sized and shaped to receive the cam.

12. The cam assembly of claim 11, wherein the slot defines a plurality of steps.

13. The cam assembly of claim 12, wherein the cam assembly comprises a securement member which extends through the upright.

14. The cam assembly of claim 11, wherein the cam lock cover plate defines a ring.

15. The cam assembly of claim 11 wherein said cam lock cover plate is solid.

16. The cam assembly of claim 11 wherein said cam base plate defines a ring.

17. The cam assembly of claim 11 wherein the cam base plate is shaped to correspond generally to the shape of the decking of the play unit.

18. The cam assembly of claim 11 wherein the play unit defines a channel sized and shaped for receipt of a corresponding upright.

19. A method of assembling a playground system, comprising the steps of:

providing a support post secured to a foundation;

providing a play unit defining a passageway extending through the play unit;

providing a cam base sized and shaped for engagement with the play unit, the cam base comprising a base plate having an opening sized and shaped to receive the support post, an upright extending generally perpendicularly from the cam base, and a cam extending inwardly from the upright;

providing a cam lock sized and shaped for engagement with the play unit within the passageway, the cam lock having a cover plate, a wall extending from the cover plate, an opening formed in the wall sized and shaped to receive the cam, and an upwardly sloping slot, the slot being sized and shaped to receive the cam;

securing the cam base to the support post;

seating the play unit to the cam base and support post;

seating the cam lock to the play unit and support such that the slot of the cam lock is aligned with the cam of the cam base; and rotating the cam lock relative to the cam base to tighten the cam lock down on the play unit so as to secure the play unit to the support post.

20. The method of claim 19, further comprising the steps of:

providing a tool shaped and sized for engagement with the cam lock;

the step of rotating the cam lock including engaging the tool with the cam lock; and rotating the cam lock with the tool.

* * * * *